US005191988A

United States Patent [19]

Reil et al.

[11] Patent Number: 5,191,988

[45] Date of Patent: Mar. 9, 1993

[54] PACK WITH PERIPHERAL SEAM FOR FLOWABLE CONTENTS

[75] Inventors: Wilhelm Reil, Bensheim; Ulrich Deutschbein, Mühltal; Gerd Knobloch, Griesheim; Udo Liebram, Pfungstadt, all of Fed. Rep. of Germany

[73] Assignee: Tetra Pak Holdings S.A., Pully, Switzerland

[21] Appl. No.: 621,616

[22] Filed: Nov. 30, 1990

[30] Foreign Application Priority Data

Dec. 2, 1989 [DE] Fed. Rep. of Germany ..... 3939970
Apr. 11, 1990 [EP] European Pat. Off. ..... 90106965.8

[51] Int. Cl.[5] ..... B65D 1/42
[52] U.S. Cl. ..... 220/4.24; 215/1 C
[58] Field of Search ..... 220/4.21, 4.24, 601, 220/669, 671, 678, 680; 215/1 C

[56] References Cited

U.S. PATENT DOCUMENTS 2,936,920 5/1960 Wallace ..... 215/1 C
3,176,879 4/1965 Mojonnier ..... 220/4.24 X
3,366,290 1/1968 Mojonnier et al. ..... 215/1 C X
3,390,816 7/1968 Mojonnier ..... 215/1 C X
4,609,106 9/1986 Gentili ..... 215/1 C X
4,969,922 11/1990 Platte, Sr. ..... 215/1 C

FOREIGN PATENT DOCUMENTS 1795668 6/1959 Fed. Rep. of Germany .
1955857 2/1967 Fed. Rep. of Germany .
928448 6/1963 United Kingdom .

*Primary Examiner*—Steven M. Pollard
*Attorney, Agent, or Firm*—Michael L. Dunn; Howard M. Ellis

[57] ABSTRACT

A pack for flowable contents, the pack having side walls which together from a tube, two end walls, one of which is an essentially flat bottom wall and the other of which is an essentially flat top wall and having a closable hole wherein the pack consists of plastic material, characterized in that a seam standing out from the side walls of the pack encompasses the pack, and lies in a plane which is disposed so that it is parallel to the longitudinal central axis of the tube, that the seam is arranged so that it extends in a depression in the region of the bottom and top wall, and that a part of the depression in the top wall surrounds the pouring device.

The pack may further include a closable pouring device for the hole, which pouring device is disposed within an outer coutour of an end wall.

16 Claims, 12 Drawing Sheets

Figure 1:
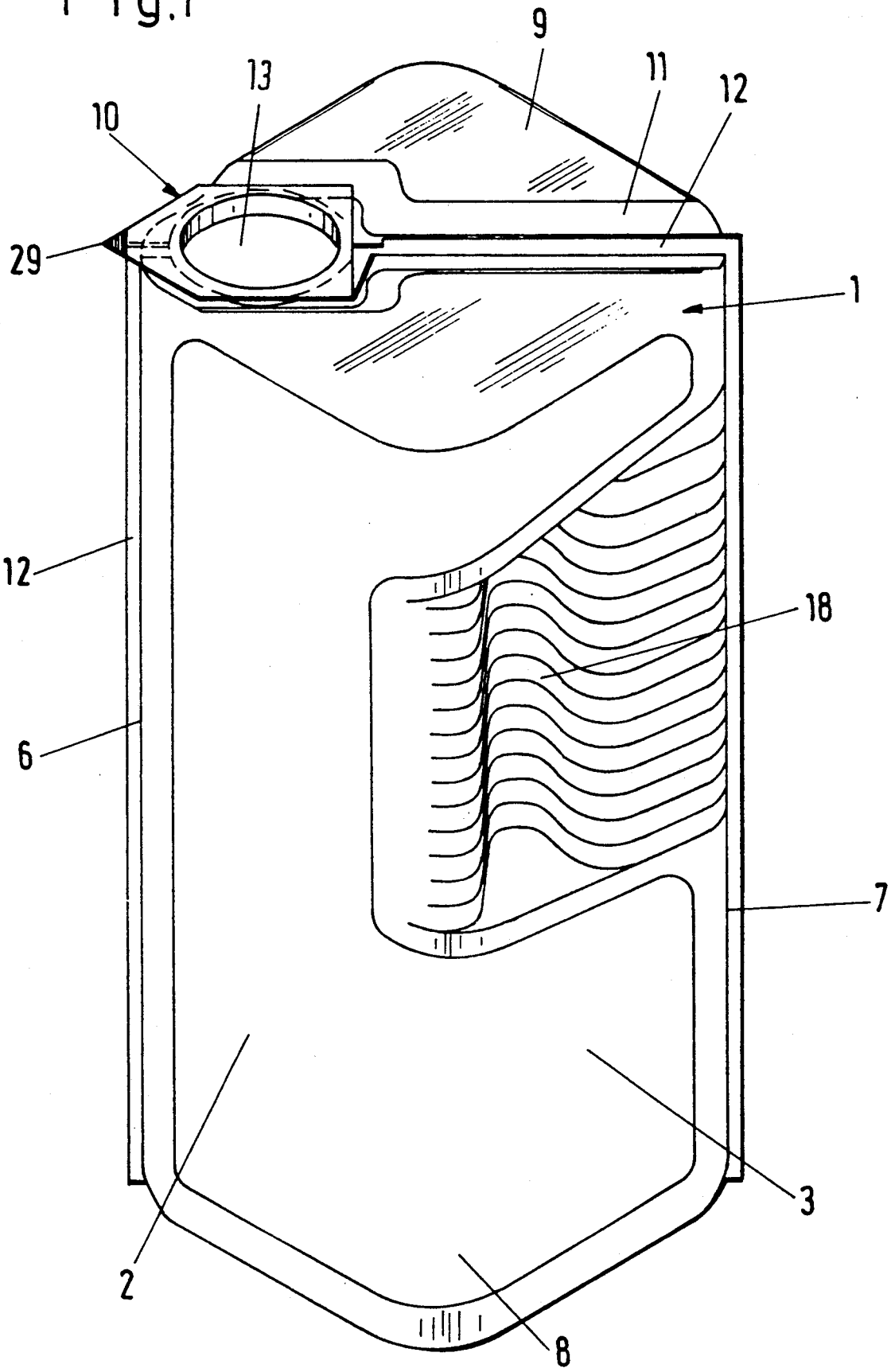

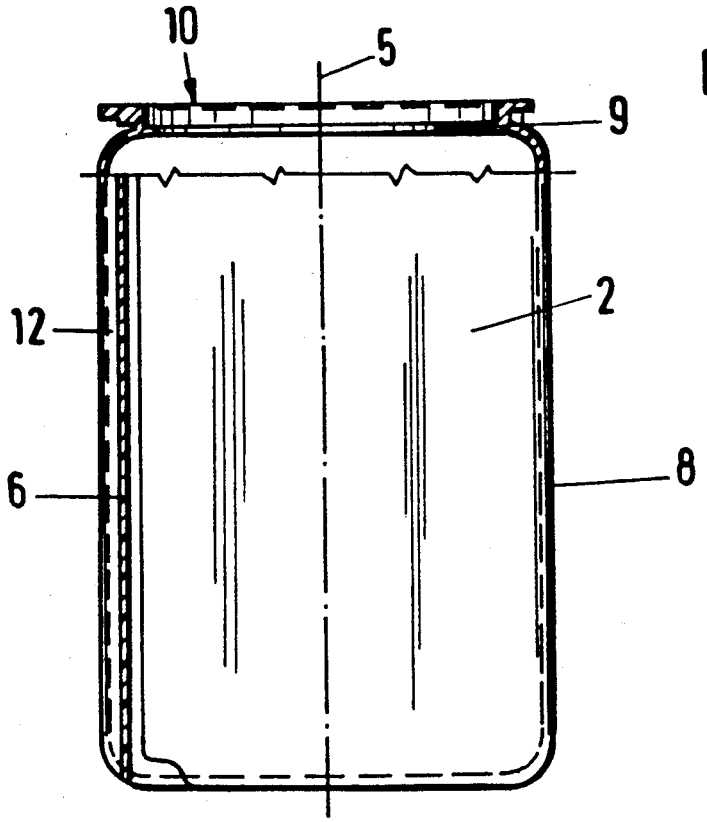
Fig.14
Fig.15
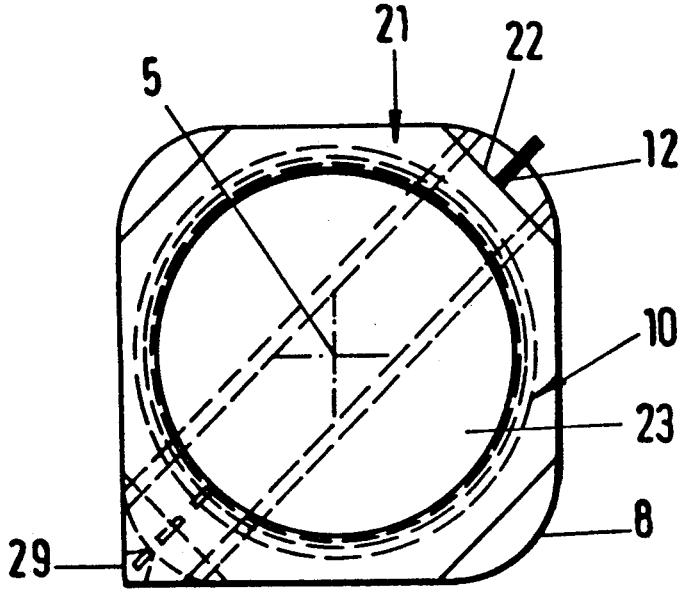

PACK WITH PERIPHERAL SEAM FOR FLOWABLE CONTENTS

The invention relates to a pack for flowable contents, the pack having tubular side walls, end walls comprising a basically flat bottom and a basically flat top wall, wherein an end wall has a closable hole which may be provided with a closable pouring device disposed inside the outer contour of the end wall, wherein all parts of the pack consist of plastic material.

Many kinds of packs are known for liquids. However, the tubular side walls of the packs at least are usually paper coated with plastics material.

Attempts are therefore being made to make containers from one and the same material instead of from composite materials, because there are better possibilities for re-using the packs and because packs of that kind are considered to be more environmentally-friendly. Known liquids packs consisting of plastic material without paper have only been able to be manufactured in small numbers up until now with expensive machines, with the result that packs of this kind are expensive and costly for the end user.

The aim of the present invention is to manufacture a cost-effectively manufacturable pack for flowable contents as a mass produced item, which is properly liquid-tight, easy to open, suitable for stacking and which is also environmentally-friendly.

This problem is solved according to the invention in that a seam which stands out from the side walls of the pack covers the pack and lies in a plane which is disposed so that it is parallel to the longitudinal central axis of the tube, that the seam is arranged so that it extends in a depression in the region of the bottom and top wall, and that a part of the depression in the top wall surrounds the hole disposed there which may be provided with a pouring device. The new pack consists entirely of plastic material without a paper substrate, and has end walls, one of which is an approximately flat bottom wall and the other of which is an approximately flat top wall. The seam reinforces the pack and preferably projects from the respective surface of the walls somewhat vertically, without affecting the capacity for stacking, because the seam extends in a groove-like depression in the region of the bottom, on the one hand, and in the region of the top wall, on the other hand. With the new design wherein there is a tube and a seam, the pack is properly liquid-tight and it can be manufactured as a mass-produces item. The plastics material permits environmentally friendly disposal after use and emptying of the pack according to the invention.

The tube forming the side walls can be round or oval in cross-section, but the pack is preferably quadrangular.

It is also expedient according to the invention if the side walls form a tube which is quadrangular in cross-section and which preferably has rounded edges, and if the seam extends along the diagonals of one of the end walls, e.g., the top wall, and is interrupted by the hole optionally provided with a pouring device. The hole with or without a pouring device likewise lies in a depression in the end, e.g., top wall, in the vicinity of the outer edge of the top wall. If the tube is quadrangular the cross-section thereof being a square, for example, or a rectangle, the seam cuts across the pack diagonally in such a way that the top wall is preferably divided into two halves, and in addition the seam extends across the hole and pouring device. To empty the pack, it is important that after opening, the contents can be poured out easily, and the pack is therefore designed in such a way that the seam does not pass through the hole in a transverse direction but only extends outside the same on the top wall. Similarly, when the pouring device is present, the seam does not pass through the pouring opening. The seam is preferably designed on the outside so as to be a short distance, 1 mm to 7 mm, for example, and preferably 2 to 6 mm from its respective outer edge of the pouring opening, and is shortened or compressed by a small height, e.g., by 1% to 30%, preferably 10% to 20% of the height of the rest of the seam, so that the manufacturer has enough space to take suitable steps for a practical pouring device. A description follows of an actual opening piece which is sealed onto the top wall to form the pouring device, and for this purpose the seam is interrupted in the region of the pouring device. The pouring device has an edge around a hole in the top wall, and where the seam is interrupted, i.e. where there is no seam, the edge is responsible for reinforcing the pack. The seam is thus disposed almost on this edge of the hole in the top wall so that there is excellent rigidity of the top wall even in the region of the pouring device.

Despite the quadrangular cross-section of the tube of the pack, the edges thereof can be considered as being rounded, so that the outside of the pack is pleasing to the eye, and for the purpose of space conserving transportation and improved stacking of the filled pack when joined together, the seam which extends parallel to the longitudinal axis of the tube outside two oppositely disposed side walls is not destroyed. If the seam is only as high as the rounded configuration of the edge of the tube on the side walls, then the seam on two oppositely disposed edges of the side wall of the tube is received into that tube by the space made available by the rounded configuration. If, with a quadrangular tube of this kind, geometrically large planes were to be placed in the outer upper surface of the four side walls, then the seam would not extend beyond the space made by these four planes, either. Thus, it is possible to have arrangements of packs according to the invention which can be stacked properly and which conserve space when joined together.

It is favorable according to the invention if the parts of the pack are made of deformable plastics material, preferably a thermoplastic material, and if the seam around the outside of the pack is formed from two bar portions which are welded together. Plastics materials are known which are deformable by the cold and by heat, and which are all suitable for producing a pack according to the invention. The plastics material of the pack should preferably be deep-drawable, however, in particular a thermoplastic plastics material such as polypropene, for example. PVC can also be used as a thermoplastic plastics material, for example, and in the art polypropene is also widely known as polypropylene. The pack according to the invention then consists of parts and materials which can be reused satisfactorily (as opposed to compound materials). With a particularly advantageous embodiment, the plastics material, e.g., polypropene, can also be filled, wherein the fillers here could be chalks, mica, talc, gypsum or the like. In practice, filling degrees of approximately 60% have proved favorable. It has been shown that these kinds of filled plastics materials are deep-drawable and also sealable.

If the seam consists of two bar portions welded together, then it is possible for the pack according to the invention to also be formed from two cup-shaped portions which are both welded to form a unit along the superposed bar portions at the ends.

It is also advantageous according to the invention if at least two side walls each have a respective depression forming a handle mould. A mould of this kind can be manufactured relatively easily using a thermoplastics material, either by cold deformation or by the conventional deep-drawing technique. The handle moulds replace a handle placed on the outside of the pack. This means that the outside contour of the pack can be designed so that it takes well to stacking. In addition, the mould can be designed such that the volume of the container is itself not significantly adversely affected or reduced. If handle moulds are provided for a pack with a quadrangular tube, then these handle moulds are best arranged on both sides of a longitudinal edge between two side walls, the longitudinal edge lying parallel to the longitudinal central line of the pack and extending through the plane with the seam. The handle moulds then end towards the "back" and are spread out smoothly in the aforedescribed outer longitudinal edge, and are disposed substantially in the upper half of a pack; with packs of smaller volume, ½ liter or ¼ liter, for example, they are disposed somewhat in the middle of the side wall with respect to the height of the pack. The respective handle mould ends to the "front" where the pouring device is arranged (obviously a considerable distance from the pouring device) somewhere in the region of a longitudinal side edge of the tube which could be termed the "central longitudinal edge", because it is not the front longitudinal side edge disposed beneath the pouring edge next to the pouring device, and neither is it the rear longitudinal edge, described hereinabove. By way of these central longitudinal side edges, another plane could be imagined as existing, and this plane would then be vertical to the afore-mentioned plane which extends through the seam.

It is expedient if the invention is also designed so that the pouring device has a separate opening piece made of deformable plastics material, the opening piece being inserted into a hole in the top wall and being welded in the top wall. Manufacture of a pack like this is then particularly simple because the tube produced from the deformed plastics material and having a bottom and a top wall then only needs to be formed with a hole in the top wall, into which hole an appropriately shaped opening piece is welded in the form of a pouring device. The opening piece can be pre-manufactured separately, and it can be inserted with high output (numbers per unit of time) into the hole in the top wall of the pack, and welded there.

Therein, it is particularly favorable if the opening piece of the pouring device has a bottom part and a closure part which is joined to the bottom part by a hinge. This kind of design makes a particular simplification to the opening piece. Functional parts connected by a hinge are able to be manufactured and assembled easily. This is the case even with the most diverse of materials, wherein the material for the opening piece according to the invention is preferably deformable plastics material. The bottom part is then welded in the way described into the hole in the top wall of the pack, and the closure part is firstly joined by way of the hinge to the bottom part and is then joined to this by a weld line.

According to the invention, it is actually provided that the bottom part is sealed to the closure part along a weld line which gives the pouring opening, and the opening piece has a cup-shaped depression which occupies the pouring opening. By virtue of the afore-mentioned weld line, the bottom part of thus joined to the closure part in such a way that when the pack is ready and filled but not yet opened, both parts of the opening piece, namely the bottom part of the closure part, such as a piece, close the hole in the top wall of the pack and if necessary keep it closed in liquid-tight manner. Both parts, the bottom part and the closure part, have the afore-mentioned cup-shaped depression, so that in addition to the adhesion and sealing force between the edge of the hole in the top wall of the pack and between the bottom part there is a certain form-locking connection between the top wall and the opening piece. If an upward tear is now made in order to open the closure part, then the tearing force is introduced into the weld line in such a way that the tear-up portion disposed within the weld line remains stuck to the closure part, and is torn out of the bottom part, giving the pouring opening—defined, thus by the contour of the weld line-. Thereby, a clearly delineated opening is created which can be made easily and which can even be closed again by the end user after the pack has been opened for the first time.

It is also advantageous according to the invention if the opening piece is welded along the edge of the hole in the top wall. This measure is one which has already been mentioned for the purpose of practical fixing of the pre-manufactured opening piece after insertion thereof into the hole in the top wall.

With another advantageous embodiment of the invention, the closure part has a panel which covers the pouring surface of the bottom part, and the panel has a tip for gripping. In other words, the opening piece is designed such that the bottom part thereof has a pouring surface which surrounds the pouring opening, and which expediently acts as a pouring edge at the frontmost tip or edge. This pouring surface which is generally substantially flat should be covered—not in the least for reasons of hygiene—after it has been closed again until used for pouring a second or third time. Covering is effected by the panel of the closure part which, like the pouring surface, fits over the cup-shaped depression of the opening piece. Therefore, the panel has, in the direction of the poured jet, towards the front longitudinal side edge of the pack, a tip which the end user can use to hold the closure part and to tear it. The tip can also project to form a gripping aid.

If, with a preferred embodiment, it is desirable to store, transport and then pour out a pasty liquid, particularly yoghurt, for example, then it is expedient if according to the invention the pouring opening occupies the greatest part of the top wall. With less viscous contents, it is sufficient to have a smaller opening piece having a pouring opening of smaller surface area. With yoghurt or other pasty contents, the pouring opening should, on the other hand, be larger, preferably occupying the major part of the top wall.

Figure 2:
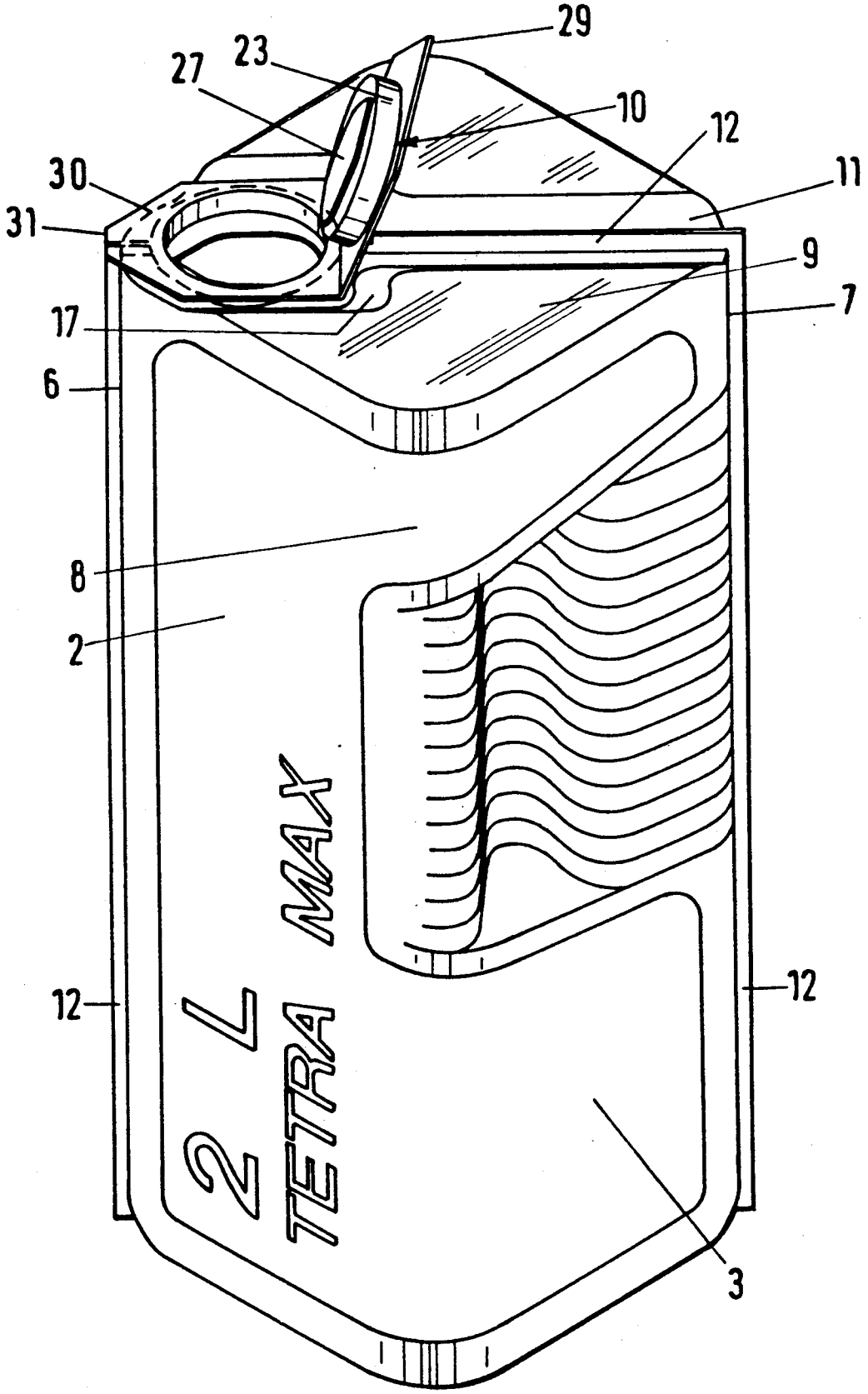
Figure 3:
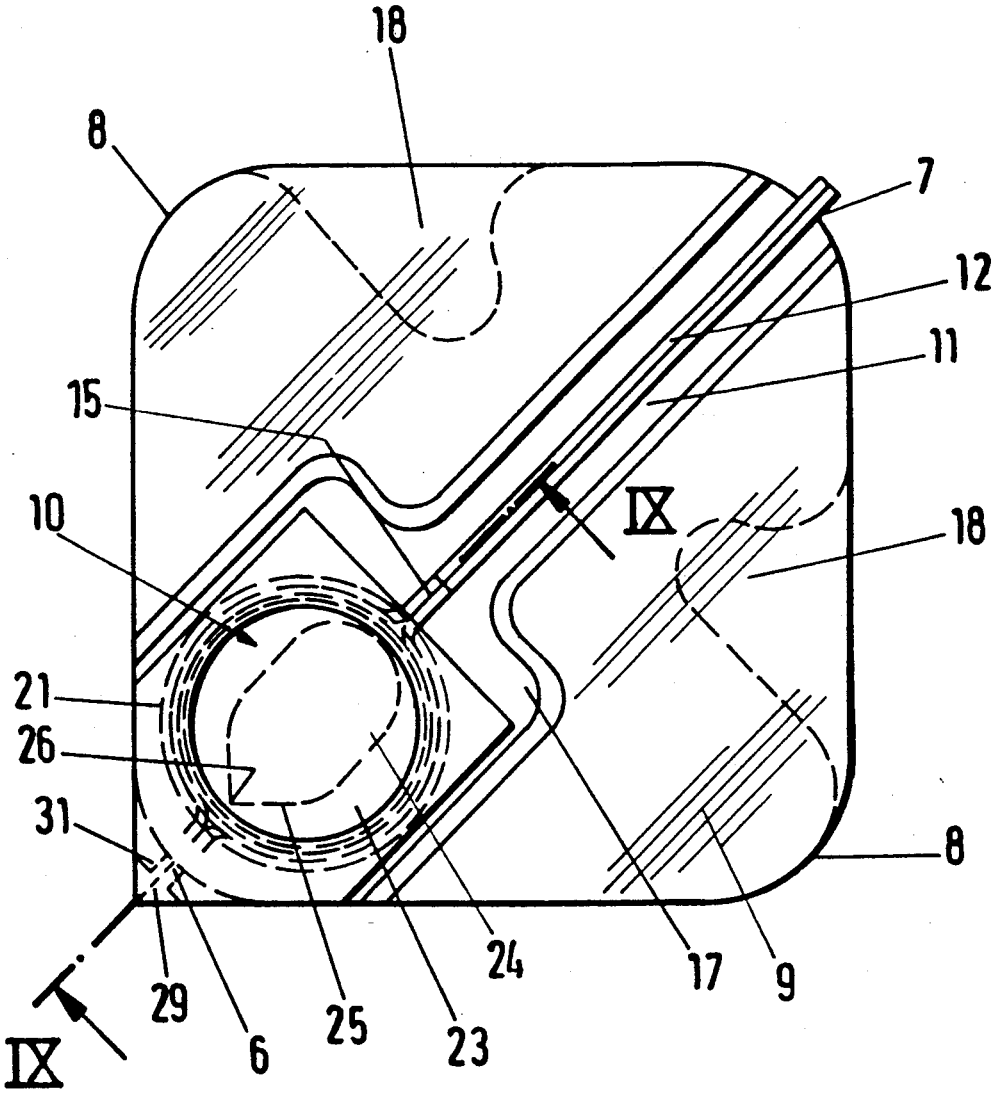
Figure 4:
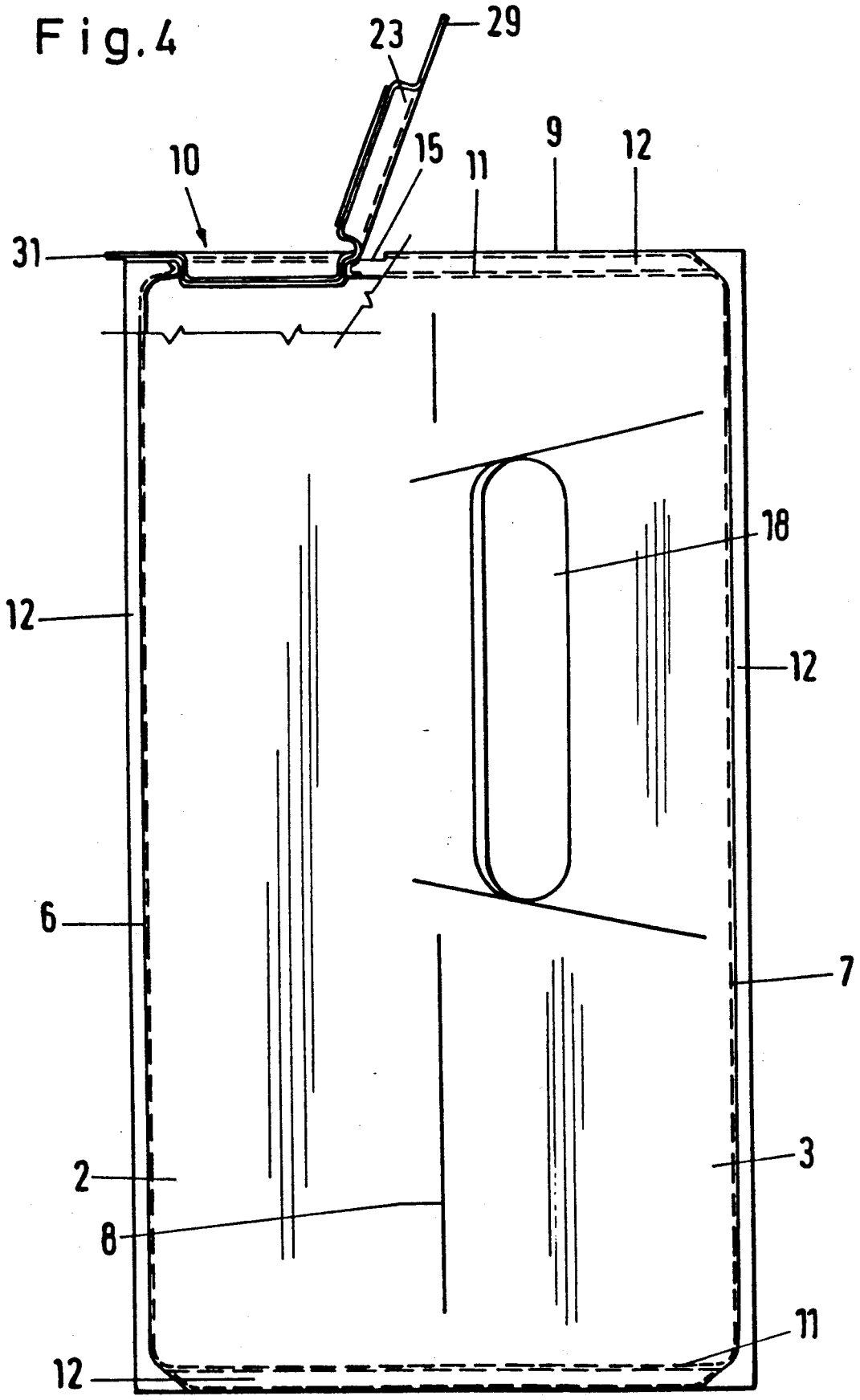
Figure 5:
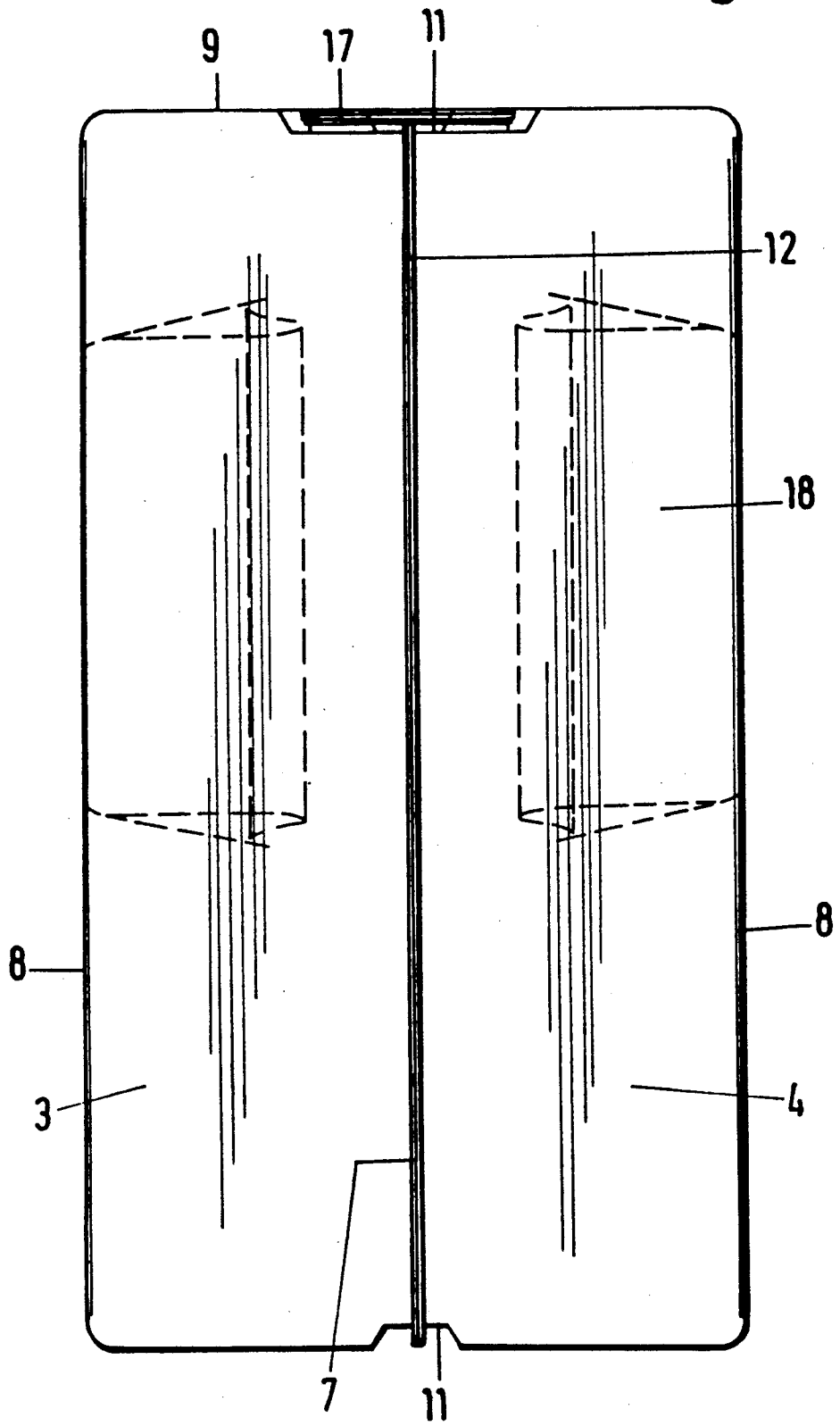
Figure 6:
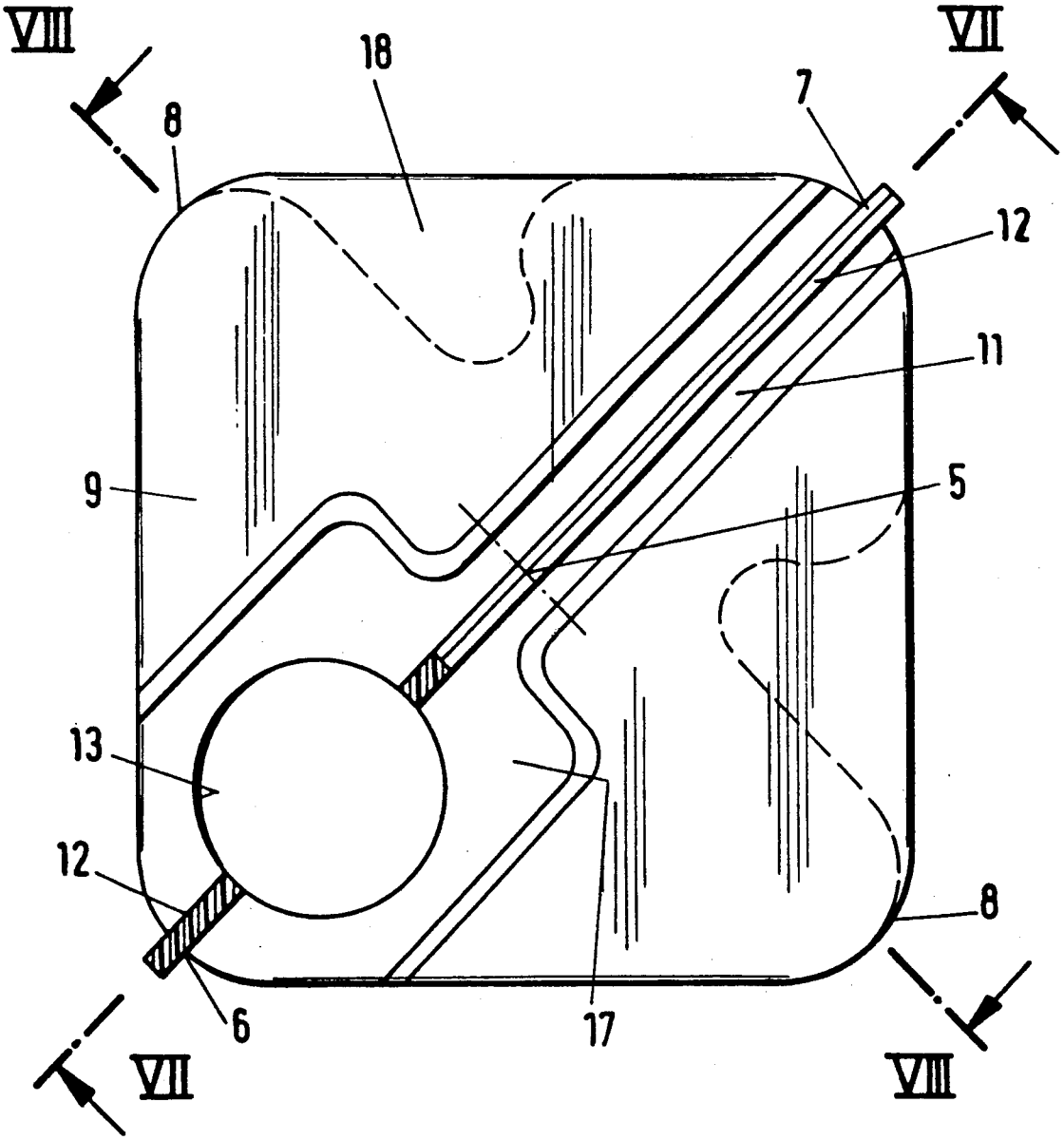
Figure 7:
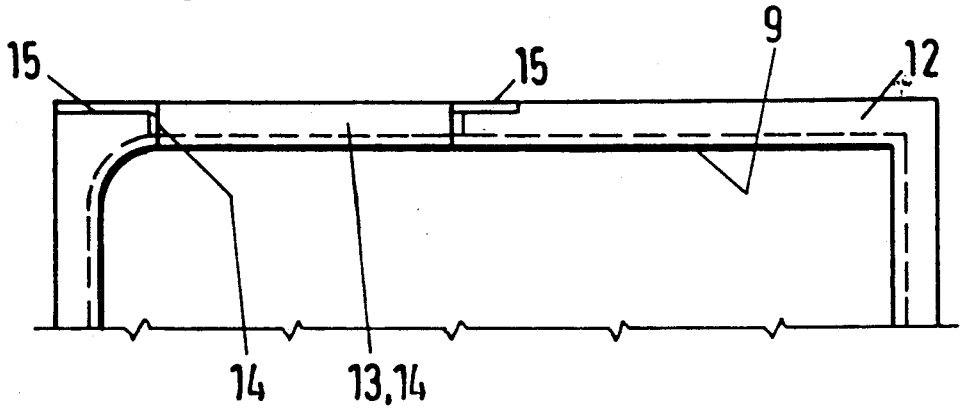
Figure 8:
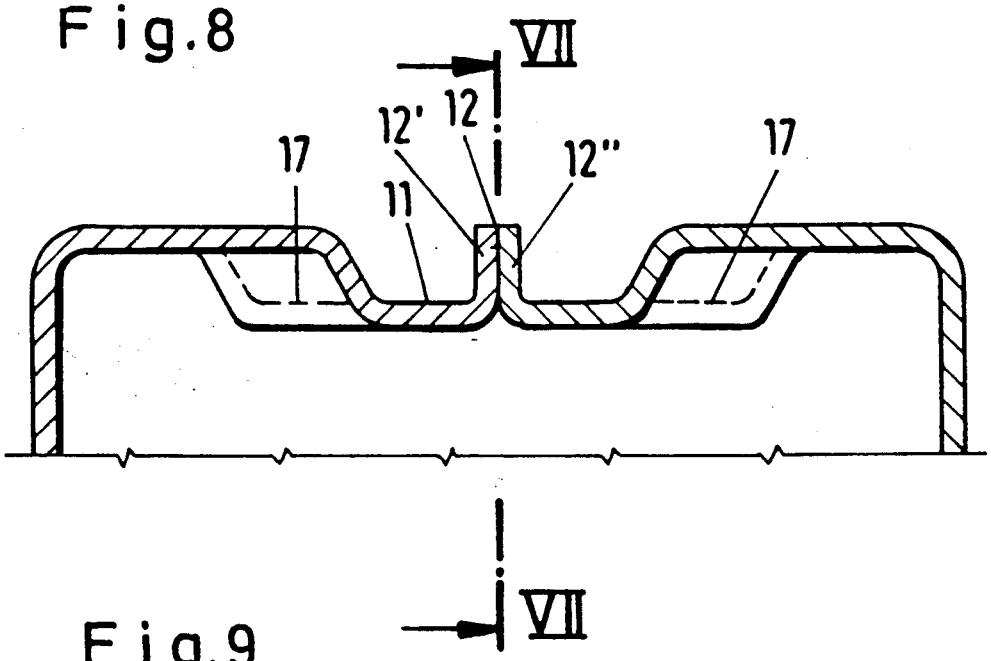
Figure 9:
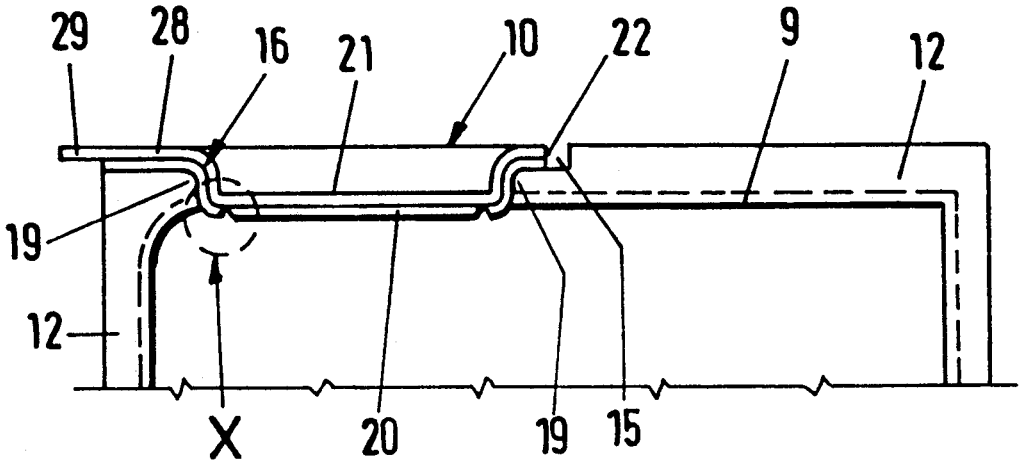
Figure 10:
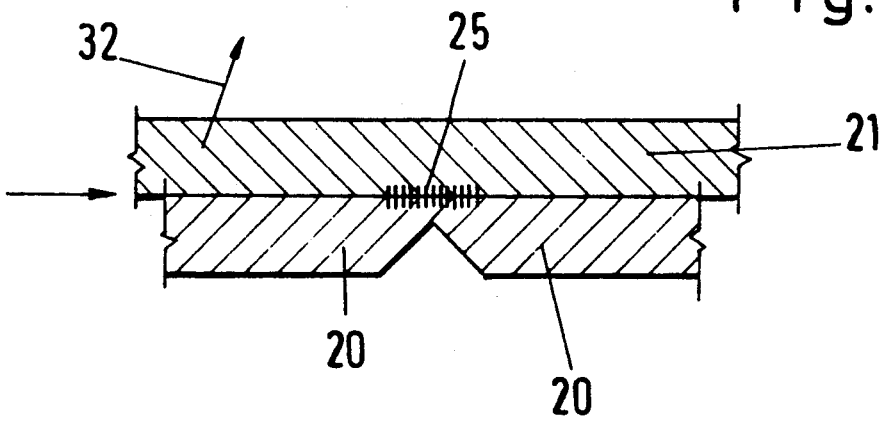
Figure 11:
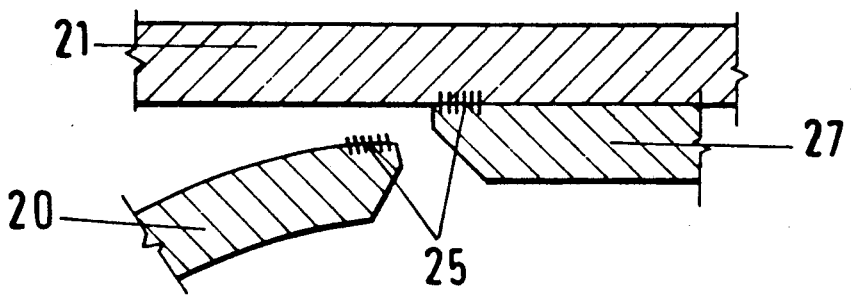
Figure 12:
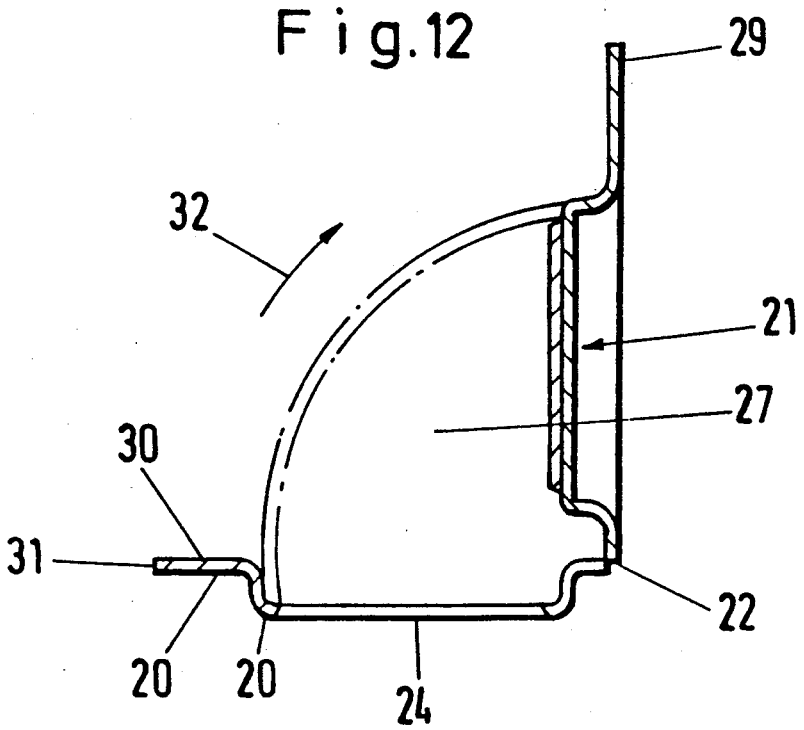
Figure 13:
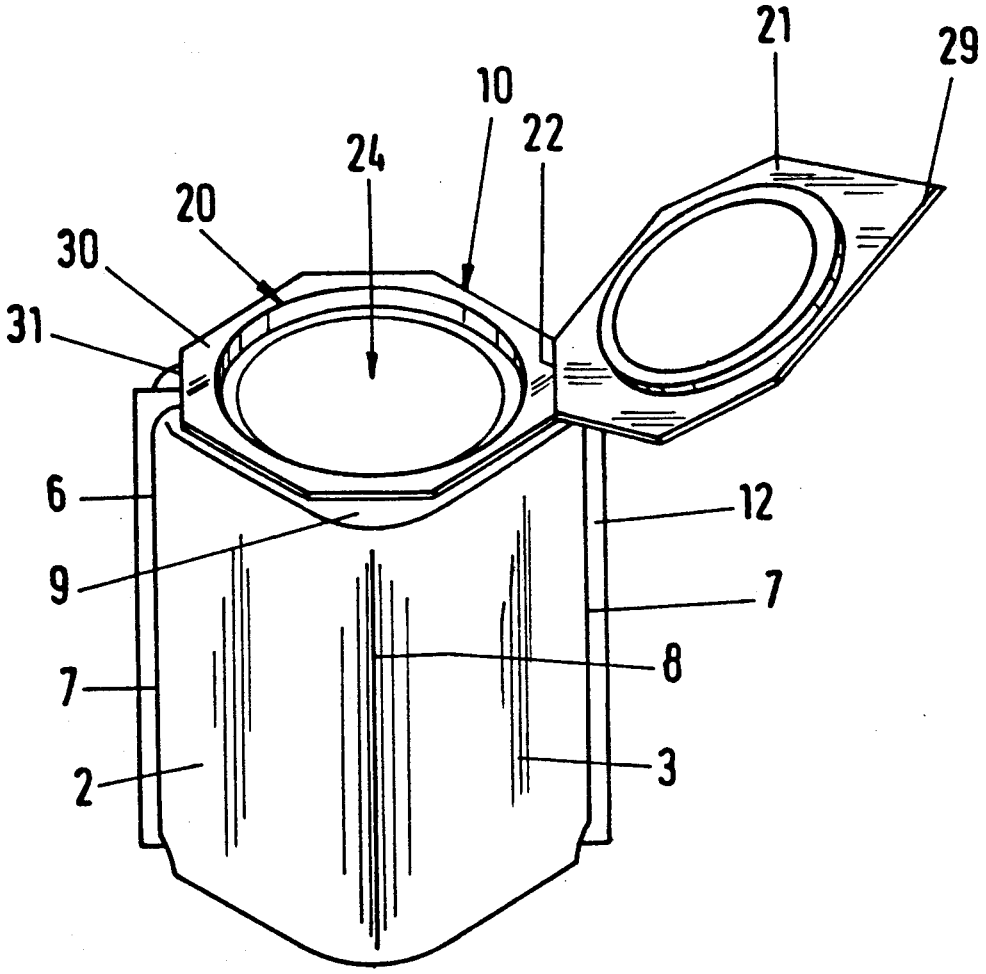
Figure 16:
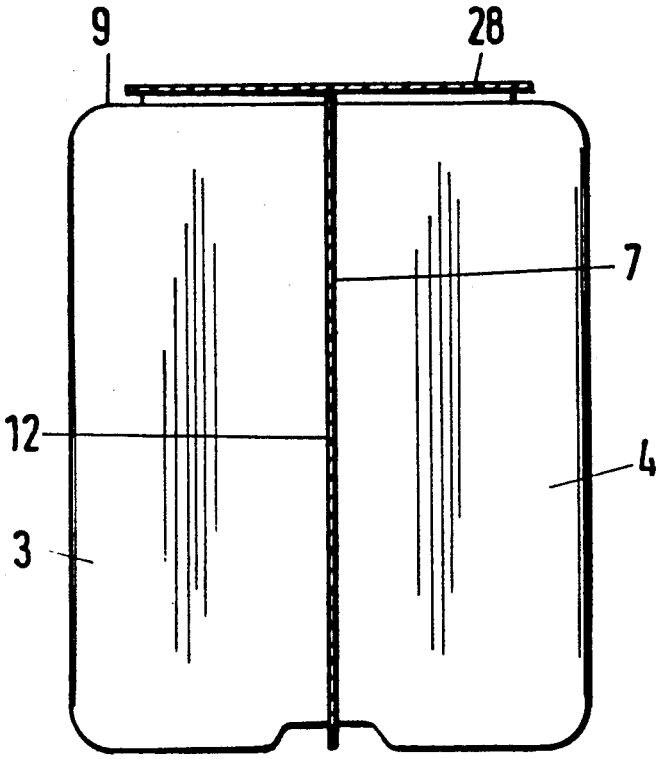
Figure 17:
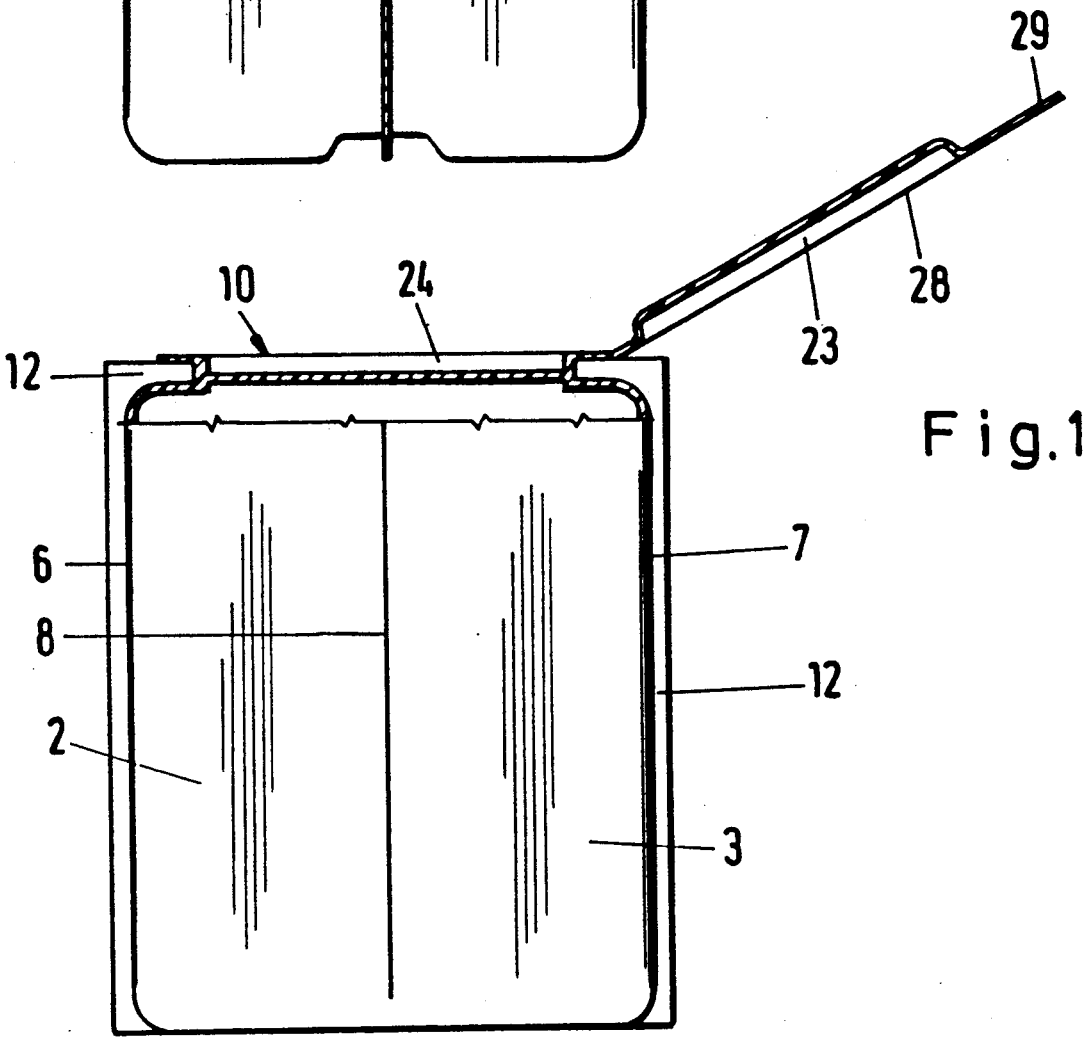
Figure 18:
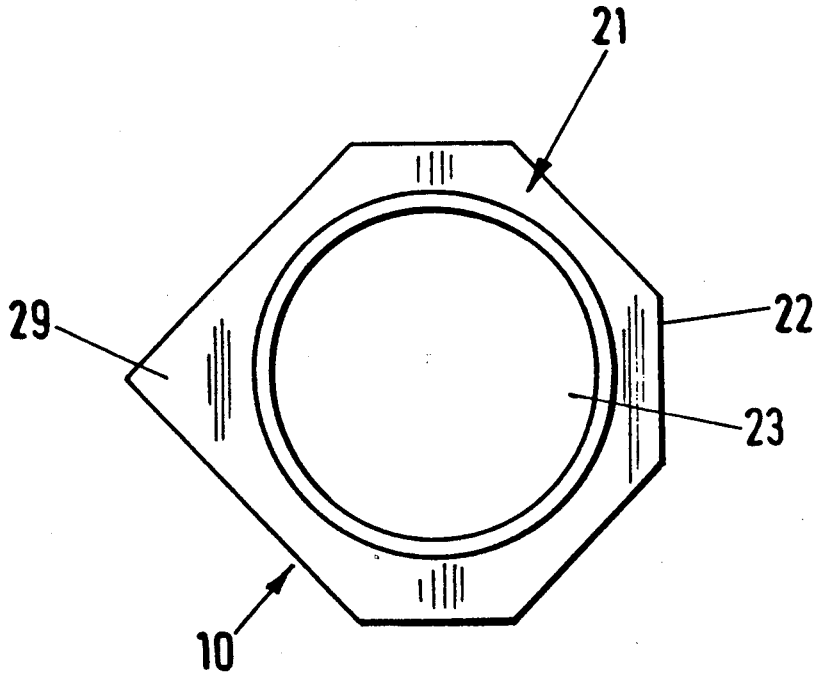

Further advantages, features and possible applications of the present invention will emerge from the following description of a preferred embodiment, given in conjunction with the drawings, wherein:

FIG. 1—shows a perspective view of the closed pack, looking onto the central longitudinal side edge, the rear longitudinal side edge to the right and the front longitudinal side edge to the left, FIG. 2—also shows a perspective view of the pack, but after the pouring device has been opened, which is arranged to the front in the top wall of the pack, the pack preferably having a volume of 2 liters, FIG. 3—shows the plan view of the closed pack according to FIG. 1, FIG. 4—shows the side view of the pack after opening, in the condition according to FIG. 2, FIG. 5—shows a rear view of the closed pack, as viewed from the rear longitudinal side edge in FIG. 1 towards the front in the direction of the pouring device, FIG. 6—shows a plan view of the pack without the opening piece, wherein in the front region of the top wall being looked at, only the hole inside the depression is visible, FIG. 7—shows a cross-sectional view along the line VII—VII of FIG. 6, FIG. 8—shows a broken-up cross-sectional view along the line VIII—VIII of FIG. 6, however, only of the top part of the pack, such as is also shown in FIG. 7, FIG. 9—shows a view along the line IX—IX of FIG. 3, FIG. 10—shows an individual view across the circle in FIG. 9, shown by a broken line, FIG. 11—shows a similar single view, on a large scale, to that in FIG. 10, but after the closure part has been torn, FIG. 12—shows a schematic side view of the opened opening piece, wherein the closure part is pivoted about the hinge through 90°, and projects vertically from the top wall of the pack if the bottom part is taken as lying horizontally in the top wall of the pack, FIG. 13—shows a perspective view of another embodiment of the pack in the opened condition, which is comparable to the condition shown in FIG. 2, wherein, however, the pouring opening occupies the greatest part of the top wall, FIG. 14—shows a side wall of the closed pack of the embodiment according to FIG. 13, looking onto the front left-hand side wall of the pack, so that the right-hand, rear longitudinal side edge is not visible, FIG. 15—shows a plan view of the closed pack according to FIG. 14, FIG. 16—shows a rear view of the closed pack, looking onto the rear longitudinal side edge to the front in the direction of the pouring edge, FIG. 17—shows a side view of the opened pack of the embodiment according to FIG. 13, looking onto the central longitudinal side edge and with the pouring edge arranged on the left, and FIG. 18—shows a plan view of the opening piece with an embodiment according to FIG. 13.

The pack which is used in the preferred embodiments described here, according to FIGS. 1 to 12 is intended for milk, juices or the like, and the pack according to FIGS. 13 to 18 is intended for yoghurt, for example.

The respective packs consist of a tube quadrangular in cross-section, having four side walls 2, 3, 4, but the fourth side wall is not shown in any of the drawings. However, it is possible to imagine this fourth wall being disposed in diametrally oppositely disposed relationship to the side wall 3. The four side walls 2 to 4 are separated from one another by longitudinal side edges which are all disposed parallel to the longitudinal central line 5 of the pack. The front longitudinal side edge 6, the rear longitudinal side edge 7 and the two central longitudinal side edges 8 are shown here, the latter being diametrally oppositely disposed to one another between the front 6 and the rear longitudinal side edge 7. In FIGS. 4, 13, 17 the central longitudinal side edges are marked by a line, but in actual fact all the longitudinal side edges are rounded, and for this reason, particularly with the perspective views, no sharp line 8 is visible. However, it is to be appreciated that four flat side walls 2 to 4 are surrounded by, or are separated from one another by, four—preferably rounded—edges 6–8. On the lower side, the tube is delimited by a bottom, not shown in greater detail, and on the upper side thereof, the tube is delimited by the top wall 9, wherein the bottom and top wall are each disposed in one plane.

With the first embodiment of the liquids pack, the plane of the top wall 9 can be seen clearly, because the hole 13 optionally comprising pouring device 10, only occupies a small part of the top wall 9, for example 5 to 30%, preferably 10 to 20% of its surface area. With the second embodiment according to FIGS. 13 to 18, however, the top wall 9 is present almost only as a ring next to the pouring device 10.

All parts 1 to 10 of the pack of both embodiments consist of deep-drawable plastics material. In FIGS. 5 and 16, it is possible to see the outer contour for both embodiments, the contour being basically quadrangular with a flat top wall 9. So that none of the parts project to any great extend beyond the outside contour, and so that good stacking and packing are possible groove-like depressions 11 are provided both in the bottom and in the top wall 9, in which grooves a seam 12 extends which projects basically vertically from the plane of the top wall 9 or of the bottom. The seam 12 covers the whole of the square or tube 1 forming the pack, and therefore continues along the front 6 and rear longitudinal side edge 7 in such a way that by virtue of the seam 12 on two walls, as can be seen particularly clearly in FIG. 8 (two seam parts 12' and 12'')—a plane can be placed which, with the embodiment shown here, halves the square of the pack exactly. With the perspective views of FIGS. 1, 2 and 13, as with the side view in FIGS. 4 and 17, a view is taken onto the plane in which the seam 12 is arranged like a frame, whereas in FIGS. 5 and 16, a view is taken in the direction of that plane and thus onto the edge of the seam 12. When viewed from the top wall 9, the seam 12 extends from one corner to the oppositely disposed one along the diagonals—as is also the case with the bottom—but, in the case of the top wall 9, is interrupted by the pouring device 10. The seam 12 stands out vertically along the front and rear longitudinal side edge 6 and 7, without it being folded over in any way and stuck to the outer surface—without projecting beyond the outer contour of the square, for the longitudinal side edges 6 to 8 of the tube 1 are rounded, and the seam 12 extends in this space to which the rounded configuration has given rise. By way of the rounded configurations of the longitudinal side edges 6 to 8, on the one hand, and the groove-like depressions 11 in the bottom and in the top wall of the pack, on the other hand, the seam 12 extends within the outer contour of the pack.

It can be seen particularly clearly in FIG. 6 that the seam 12 is interrupted by the hole 13 in the top wall 9. In other words, the seam 12 Which extends across the top wall 9 in a straight line, ends in front of the edge 14 of the hole 13, is absent in the region of the hole because there is no material here, and continues again on the oppositely disposed side beyond the hole 13. In regions next to the hole which can be seen in FIGS. 7 and 9 and which are marked with the reference numeral 5, the height of the seam 12 is reduced by 5 to 30%, preferably by 10 to 15% of the total height of the seam 12. Thereby, an opening piece 16 which covers the hole 13 can be inserted, fixed and arranged in such a way that the pouring device 10 which has the opening piece 16 does not project beyond the outer contour of the pack either.

For this purpose, in the upper wall 9 in which the pouring device 10 is disposed, there is a widened portion 17 of the otherwise groove-like depression 11, wherein this part 17 of the depression 11 is widened in such a way that it surrounds the pouring device 10. In other words, the pouring device 10 is arranged with its opening piece 16 in such a way that it lies, depressed, in this part 17 and does not even extend over the outer surface of the top wall 9.

FIGS. 1 and 2 clearly show another depression 18 forming a handle mould. A handle mould of this kind is also intended with the second embodiment according to FIGS. 13 to 18, even though it is not actually shown there.

With the second embodiment, the seam 12 must not pass through a depression in the region of the top wall 9 because the interruption made by the pouring device 10 occupies almost the whole of the top wall 9. As a result, the top surface of the wide depression 17 according to the first embodiment for the yoghurt carton is to be imagined as being like the top wall 9 of the second embodiment.

With a pack, the volume of which is 2 liters, for example, the depression 18 giving the handle mould, is arranged in the upper half of each of the rear side walls 3 and 4, whereby the pack is held and supported by the end user very near to the center of gravity, so that pouring is comfortable and easy.

The surface surrounding the depression 18 (handle mould) and also the side wall 4 adjacent to and joining that side wall can be provided for an impression.

The pouring device 10 is a separate opening piece 16 which is inserted into the hole 10 in the top wall 9 and which is welded along the edge 14 of the hole 13 in the top wall 9. In order to describe this more accurately, it is best to first of all consider FIGS. 6 and 7. In these drawings, it is possible to see the seam 12 interrupted by the hole 13 in the top wall 9, which seam (according to a particularly clear drawing in FIG. 8) consists of the two bar portions 12', 12'' welded together, and extends in the depression 11 or in the widened depression 17.

In order to form the pouring device 10, as designed according to the theory of both the embodiments shown here, it is best if FIGS. 3, 9 and 12 are considered. The pouring device thus consists of the opening piece 16 which is welded into the hole 13 along the annular edge 14. FIG. 9 clearly shows the weld region 19 between the opening piece 16 and the hole 13 which is illustrated by a thicker line and is annular in shape. The partly cylindrically casing like ring 14 which is the edge of the hole 13 forms a part of this weld surface 19, for the latter also continues on the top wall 9 and on the depressions 15 up onto the seam 12.

This opening piece 16 which is welded into the hole 13 of the top wall 9 along the surface 19 consists, in turn, of a bottom part 20 and of a closure part 21 which is joined to the bottom part by a hinge 22. In order to see the hinge 22 more clearly, it is best to study FIG. 12, and FIG. 13 also clearly reproduces the position of the hinge 22 of the second embodiment.

The opening piece 16, i.e., both the bottom part 20 and the closure part 21, has a cup-shaped depression 23, as can clearly be seen in the cross-sectional view of FIGS. 9 and 12. In the "bottom of this cup", there is a weld line 25 giving a desired pouring opening 24.

If the closed pouring device 10 according to FIG. 3 is studied, then it is possible to see there the weld line 25 marked by a broken line, which is fitted with a tip 26 at the front tip of the pouring device 10, in order to actually concentrate, at one point on the weld line, the tearing forces which are yet to be described, and to thereby bring the tearing forces to the correct location. In the individual part x in FIG. 9 which is enlarged in FIGS. 10 and 11, it is possible to see part of the weld line 25 in section. Prior to being torn, the weld line 25 surrounds the tear-off portion 27 which remains stuck to the closure part 21 after being torn, thereby giving the pouring opening 24 in the bottom part 20.

With the plan view of the closed pack according to FIGS. 3 and 15, a view is given of the region of the widened part 17 of the depression 11 in the top wall 9 of the pouring device, generally labeled 10, on the outer surface of the closure part 21 with the cup-like depression 23, wherein the region of the closure part 21 enclosing the depression 23 of a cup-like configuration and substantially circular, is designed as a flat panel 28, which is provided with a gripping tip 29. FIG. 9 clearly shows with regard to the first embodiment that these gripping tips 29 of the panel 28 project over the so-called pouring surface 30 with the pouring edge 31.

On use, the end user comes upon the pack shown in FIGS. 1 and 14 to 16 with a closed opening device 10. To open the pack, the end user holds the gripping tip 29 of the closure part 21 and pulls it up in the direction of the slanting arrow 32 (FIGS. 10 and 12). Owing to the weld line 25, the pulling force is concentrated onto the tip 26, and for this reason the weld line 25 also becomes the tear line, which then makes the pouring opening 24 after it is torn. The tear along this weld line 25 is effected in the way illustrated in FIG. 4, so that the tear-off portion 27 is torn from the bottom part 20 and is torn up over the rest of the part of the weld line 25 and is left hanging on the closure part 21. Therein, the closure part, as shown in FIG. 12, flaps about the hinge 22, with movement in the direction of the curved arrow 32, into the upright position, for example. The pouring opening 24 is formed in this position, for the tear-off piece 27 is suspended on the closure part 21. The pouring process can begin. Both embodiments reach the condition shown in FIG. 2 and FIG. 13. When the pack is tilted, the contents flow over the pouring surface 30, and are formed into a clearly definable jet along the pouring edge 31.

To close the pack again, the closure part 21 simply has to be folded down again in the direction opposite to that of the curved arrow 32 (FIG. 12).

What is claimed is:

1. A plastic container for a flowable material, said container having side walls which together form a tube, two end walls, one of which is an essentially flat bottom wall and the other of which is an essentially flat top wall, one of said end walls having a closable hole, each of said bottom and top walls having a depression extending thereacross, a seam standing out from said side walls of said container encompasses said container and lies in a plane which is disposed so that it is parallel to the longitudinal central axis of said tube, said seam being arranged so that it extends in said depression in the region of said top and bottom walls, and that part of the depression surrounds the closable hole.

2. A container according to claim 1, including a closable pouring device for said closable hole, said pouring device being disposed within an outer contour of an end wall, within said depression so that at least a part of the depression surrounds the pouring device.

3. A container according to claim 2, wherein said pouring device is disposed within the contour of said top wall.

4. A container according to claim 2, wherein said side walls form a tube which is quadrangular in cross section, and which preferably has rounded edges, and said seam extends diagonally along said top wall and is interrupted by said pouring device.

5. A container according to claim 2, which comprises a deformable thermoplastic material, and the seam around the outside of said container is formed from two bar portions welded together.

6. A container according to claim 2, wherein at least two side walls each have a depression forming a handle.

7. A container according to claim 2 wherein said pouring device comprises an opening piece of deformable plastic material welded into said hole in said top wall.

8. A container according to claim 2, wherein said pouring device comprises a bottom portion and a closure portion joined to said bottom portion by means of a hinge.

9. A container according to claim 8 wherein said bottom portion is sealed to said closure portion along a weld line which defines a pouring opening, the bottom portion and opening piece having mating cup shaped depressions.

10. A container according to claim 9, wherein said opening piece is welded along an edge and surface of the hole in the top wall.

11. A container according to claim 9 wherein the pouring opening in the top wall occupies the greatest part of the top wall.

12. A container according to claim 8 wherein said closure portion comprises a plate with a tip for gripping, which plate covers a pouring surface of the bottom portion.

13. A container according to claim 1, wherein said side walls form a tube which is quadrangular in cross-section, and which preferably has rounded edges, and said seam extends diagonally along said top wall and is interrupted by said closable hole.

14. A container according to claim 1, which comprises a deformable thermoplastic material, and the seam around the outside of said container is formed from two bar portions welded together.

15. A container according to claim 1, wherein at least two side walls each have a depression forming a handle.

16. A container according to claim 1 wherein said hole is disposed within the contour of said top wall.

* * * * *